US009776817B2

(12) United States Patent
Matsumoto

(10) Patent No.: US 9,776,817 B2
(45) Date of Patent: Oct. 3, 2017

(54) IMAGE READING DEVICE AND IMAGE FORMING APPARATUS

(71) Applicant: CANON KABUSHIKI KAISHA, Tokyo (JP)

(72) Inventor: Akira Matsumoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/978,632

(22) Filed: Dec. 22, 2015

(65) Prior Publication Data

US 2016/0185541 A1 Jun. 30, 2016

(30) Foreign Application Priority Data

Dec. 26, 2014 (JP) ..... 2014-264784

(51) Int. Cl.
*B65H 5/06* (2006.01)
*B65H 5/36* (2006.01)
*B65H 5/38* (2006.01)

(52) U.S. Cl.
CPC ..... *B65H 5/062* (2013.01); *B65H 5/36* (2013.01); *B65H 2402/545* (2013.01); *B65H 2404/133* (2013.01); *B65H 2404/1421* (2013.01); *B65H 2404/1431* (2013.01); *B65H 2404/6111* (2013.01); *B65H 2801/06* (2013.01); *B65H 2801/39* (2013.01)

(58) Field of Classification Search
CPC .. B65H 5/062; B65H 5/36; B65H 2404/1431; H04N 1/123; H04N 1/1235; H04N 1/121
See application file for complete search history.

(56) References Cited

U.S. PATENT DOCUMENTS 8,387,979 B2 * 3/2013 Nagura ..... B65H 5/062 271/274
2007/0102873 A1 * 5/2007 Acton ..... B65H 5/062 271/273

FOREIGN PATENT DOCUMENTS

JP 2004256229 A 9/2004

* cited by examiner

*Primary Examiner* — Luis A Gonzalez
(74) *Attorney, Agent, or Firm* — Canon U.S.A. Inc., IP Division

(57) ABSTRACT

An image reading device includes a plurality of driven roller holders arranged in a direction orthogonal to a sheet conveying direction. Some of the driven roller holders have a distal end portion extended downstream beyond outer peripheral surface of a driven roller, and some of the driven roller holders do not have the distal end portion extending downstream beyond the outer peripheral surface of the driven roller in the conveying direction.

27 Claims, 6 Drawing Sheets

IMAGE READING DEVICE AND IMAGE FORMING APPARATUS

BACKGROUND OF THE INVENTION

FIELD OF THE INVENTION

Technical Field

The present invention relates to an image reading device used in an image forming apparatus and to the image forming apparatus.

DESCRIPTION OF THE RELATED ART

Background Art

In the related art, some of image reading devices provided in image forming apparatuses such as copying machines, facsimile machines, multi-functional peripheral equipment, and the like include a sheet conveying device called an "Auto Document Feeder" (hereinafter, referred to as ADF).

The ADF conveys a sheet from a feeding-sheet stacking portion in which sheets are stacked via a sheet conveying unit configured to convey the sheet to a discharged-sheet stacking portion provided under the feeding-sheet stacking portion, and in the course of conveyance, reads an image on the sheet with an image reader. Some of the sheet conveyance routes of the ADFs include curved conveyance route portions. The sheet separated and fed from the feeding-sheet stacking portion passes through the curved conveyance route and is conveyed to the image reader configured to read the image on the sheet.

The image reading device performs reading of images with the image reader while conveying the sheet with the ADF, which is called "sheet-through system image reading". The sheet-through system image reading has a problem that a shock is applied to a sheet when a trailing edge of the sheet passes through a nip of conveying rollers provided immediately upstream in a sheet conveying direction of the image reader (hereinafter, referred to as a trailing-edge-leaving shock). The occurrence of image defects such as image burring or color deviation in read images caused by an occurrence of the trailing-edge-leaving shock is becoming a problem. Generally, there are two causes of trailing-edge-leaving shock.

One is a slight difference in velocity between a conveying velocity of conveying rollers arranged upstream in the conveying direction and a conveying velocity of conveying rollers provided downstream of the upstream conveying rollers. Due to the difference in conveying velocity between the conveying rollers, when the trailing edge of the sheet has passed through the nip of the upstream conveying rollers, the sheet is accelerated and thus a shock is applied to the sheet.

Another cause is the presence of a height difference between the nip of the conveying rollers and a conveyance guide arranged downstream of the conveying roller. Immediately after the trailing edge of the sheet has passed through the nip of the conveying rollers, behavior of the sheet becomes unstable and the trailing edge of the sheet falls onto the conveyance guide, at which time a trailing-edge-leaving shock occurs.

The former cause can be addressed by reducing the difference in velocity between the conveying velocity of the upstream conveying rollers and the conveying velocity of the conveying rollers provided downstream in the conveying direction thereof, for example, by equalizing outer diameters of the upstream and downstream conveying rollers to a maximum extent.

In order to address the latter cause, a method of reducing the trailing-edge-leaving shock by providing a flapper configured to support a document from an image recording side and causing the flapper to behave by using a driving unit configured to drive the flapper is proposed in Japanese Patent Laid-Open No. 2004-256229.

However, in the case of the apparatus disclosed in Japanese Patent Laid-Open No. 2004-256229, the driving unit configured to drive the flapper needs to be provided. Therefore, the apparatus has a complex configuration and consequently a high cost, and an increase in size of the apparatus may be disadvantageous.

SUMMARY OF THE INVENTION

A representative configuration of the invention is an image reading device including: an image reader, a conveying portion configured to convey a sheet to the image reader, the conveying portion including: a first roller unit, the first roller unit including: a first roller provided under an opposed roller; a first roller holding portion configured to hold the first roller and rotatably provided on a rotary shaft; and a first biasing portion configured to bias the first roller holding portion to bring the first roller into contact with the opposed roller, a second roller unit, the second roller unit including: a second roller provided under the opposed roller, a second roller holding portion configured to hold the second roller and rotatably provided on a rotary shaft; and a second biasing portion configured to bias the second roller holding portion so as to bring the second roller into contact with the opposed roller, in which the first roller unit and the second roller unit are arranged at a position upstream of the image reader at an image reading position in a sheet conveying direction and are arranged at different positions in a direction orthogonal to the sheet conveying direction, the first roller holding portion includes a first extended portion extending downstream beyond the first roller in the sheet conveying direction, and the second roller holding portion has no extended portion extending downstream beyond the second roller in the sheet conveying direction.

Further features of the present invention will become apparent from the following description of exemplary embodiments with reference to the attached drawings.

DESCRIPTION OF THE EMBODIMENTS

First Embodiment

Referring to FIGS. 1A to 1D, FIG. 2, and FIG. 6, a first embodiment will be described. However, the following embodiments are examples only for embodying the invention and are not intended to limit a technical scope of the invention.

Figure 6:
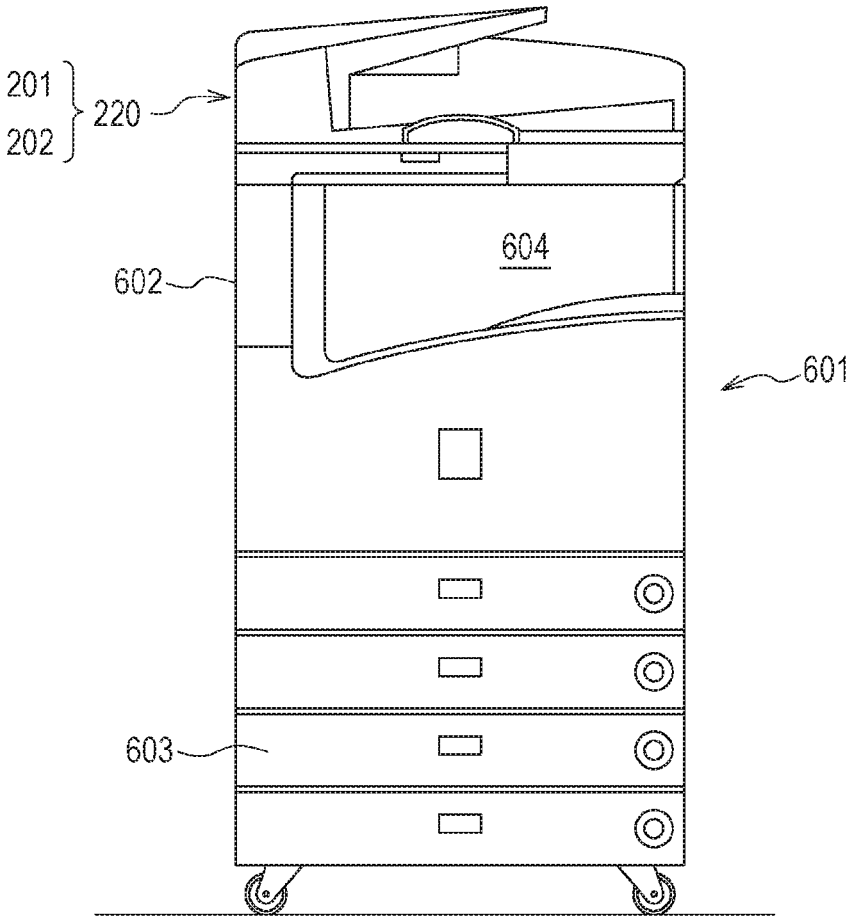
FIG. 6 is a drawing roughly illustrating an image forming apparatus provided with an image reading device.

FIGS. 1A to 1D are drawings roughly illustrating driven roller holders 104*a*/104*b*/104*c*/104*d*/104*e*. FIG. 2 is a drawing illustrating an Auto Document Feeder (ADF) (hereinafter, referred to as a "sheet conveying device") 201 configured to convey a sheet to be read (hereinafter, referred to as a "document"), and an image reader 202. FIG. 6 is a schematic drawing illustrating an image forming apparatus 601 provided with the sheet conveying device 201 and the image reader 202.

Referring firstly to FIG. 6, a schematic configuration of the image forming apparatus 601 provided with the sheet conveying device 201 and the image reader 202 according to the first embodiment of the invention will be described. In the first embodiment, the image forming apparatus 601 will be described as an image forming apparatus employing an electrophotographic system. However, the image forming apparatus is not limited thereto. The image forming apparatus may be of a type provided with an image reading device and employing an inkjet system as an image forming unit or a facsimile machine provided with an image reading device.

As illustrated in FIG. 6, the image forming apparatus 601 includes an image forming unit body 602, which corresponds to the image forming unit, a sheet feeding cassette 603 in which recording sheets are stacked, and the image reading device 220 provided with the sheet conveying device 201 and the image reader 202 for reading an image on the document.

The sheet feeding cassette 603 is mounted under the image forming unit body 602, and the image reading device 220 is mounted on the top of the image forming unit body 602.

The image forming unit body 602 is provided with a known electrophotographic image forming mechanism. The electrophotographic image forming mechanism is a print engine employing an electrophotographic system, which is known in the related art, and includes a laser writing unit, an electrophotographic process unit, a fixing unit, and the like, which are not illustrated, integrated therein. The image forming apparatus 601 in the first embodiment is configured to form an image read by the image reading device 220 on a recording sheet, which corresponds to a recording medium, conveyed from the sheet feeding cassette 603 by the image forming mechanism of the image forming unit body 602.

A space is provided between the image reading device 220 and the image forming unit body 602, and a main body sheet discharging section 604 is formed therein. Recording sheets on which images are formed by the image forming unit body 602 are discharged and stacked in the main body sheet discharging section 604.

The sheet feeding cassette 603 accommodates recording sheets therein, and the accommodated recording sheets are separated into pieces and are fed to the image forming mechanism by a sheet feeding roller and the like, which are not illustrated, provided in the image forming unit body 602.

Referring next to FIG. 2, schematic configurations of the sheet conveying device 201 and the image reader 202 which constitute parts of the image reading device 220 will be described. As illustrated in FIG. 2, the image reader 202 is provided with the sheet conveying device 201 configured to separate and feed a plurality of documents and read an image printed on the document.

The sheet conveying device 201 has the following configuration. A feeding-sheet stacking portion 203 is a stacking portion for stacking documents which are about to be fed. A pickup roller 204*a*, a separation roller 204*b*, and a retard roller 204*c*, which constitute parts of a sheet feeding unit, separate and feed the documents stacked on the feeding-sheet stacking portion 203 one by one. A plurality of rollers which constitute parts of the sheet conveying unit convey the documents separated and fed by the sheet feeding unit. The plurality of rollers include a conveying roller pair 205, a registration roller pair 206, a driving roller 207, a driven roller 103, a platen roller 209, a conveying roller pair 210, a back-side platen roller 211, a conveying roller pair 212, and a discharge roller pair 213.

A discharged-sheet stacking portion 214 is provided downstream of the discharge roller pair 213 in a conveying direction, and the documents conveyed by the sheet conveying unit are stacked therein.

A back-side image reading unit 218 is provided within a housing of the image reading device 220 so as to oppose the back-side platen roller 211. The back-side image reading unit 218 is configured to read images on back sides of the documents. The back-side image reading unit 218 is provided with a CCD (charge-coupled device), a condenser lens, and the like, which are not illustrated, and is configured to convert light reflected from the documents into electric signals and read images.

The image reader 202 configured to read an image on a surface (first side) of the document conveyed by the sheet conveying device 201 is provided under the sheet conveying device 201. The image reader 202 includes a first reading glass 215, a second reading glass 216, and an image reading unit 217.

The image reading unit 217 is provided, in the same manner as the back-side image reading unit 218, with a CCD (charge-coupled device), a condenser lens, and the like and is configured to convert light reflected from the documents into electric signals and read images. The image reading unit 217 is provided to be movable between a position opposing the first reading glass 215 and a position opposing the second reading glass 216.

The first reading glass 215 is arranged so as to oppose the platen roller 209. In the case of a sheet-through image reading system, the image reading unit 217 is located at a reading position opposing the first reading glass 215 and reads an image on a surface (second side) of the document conveyed by the sheet conveying device 201.

The second reading glass 216 is used for reading an image on a thick document such as a book. The image reading unit 217 moves in a secondary scanning direction to read an image on the book placed on the second reading glass 216.

As illustrated in FIG. 2, the document conveyed by being guided by a conveyance guide 101 is pinched between the driving roller 207 and the driven roller 103 and is conveyed to a position between the first reading glass 215 and the platen roller 209. The image on the document is read by the image reading unit located at the reading position. When a leading edge of the document reaches the conveying roller pair 210 thereafter, the document is pinched by the conveying roller pair 210. The document is then conveyed by the conveying roller pair 210, and a pair of rollers consisting of the driving roller 207 and the driven roller 103. When the document is fed in the conveying direction, a trailing edge of the document passes through a nip portion between the driving roller 207 and the driven roller 103. At this time, the problem of the trailing-edge-leaving shock described above occurs.

A configuration of a roller unit 111, which is a characteristic portion of the first embodiment will now be described with reference to FIGS. 1A to 1D. The roller unit 111 is arranged at a position immediately upstream of the image reading unit located at an image reading position in the document conveying direction.

Figure 1A:
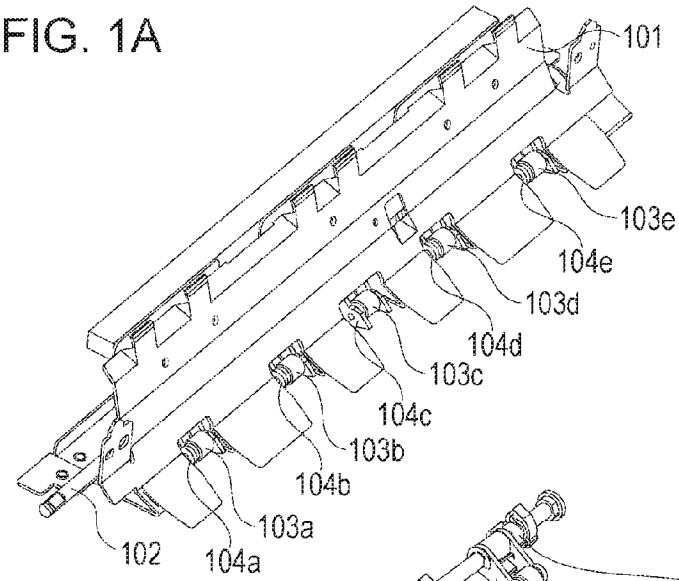
FIG. 1A is a perspective view of a portion in the vicinity of a driven roller according to a first embodiment.
Figure 1B:
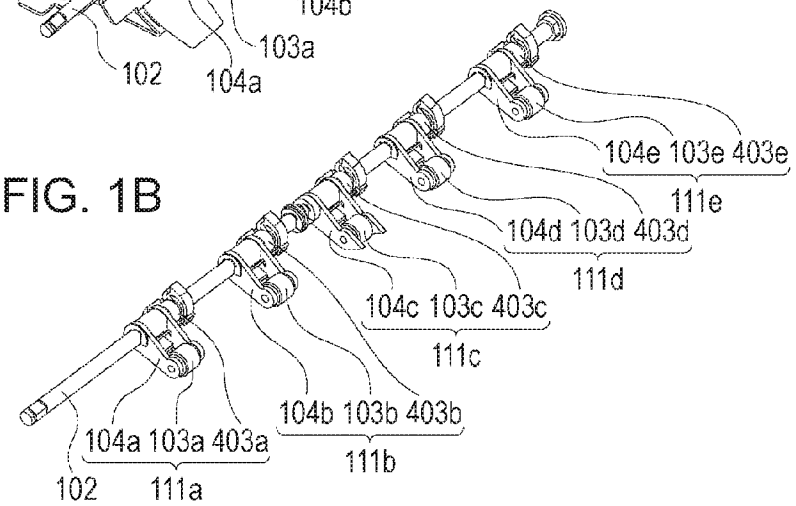
FIG. 1B is a perspective view of the driven roller in a state in which a conveyance guide in FIG. 1A is not illustrated for the convenience of explanation.
Figure 1C:
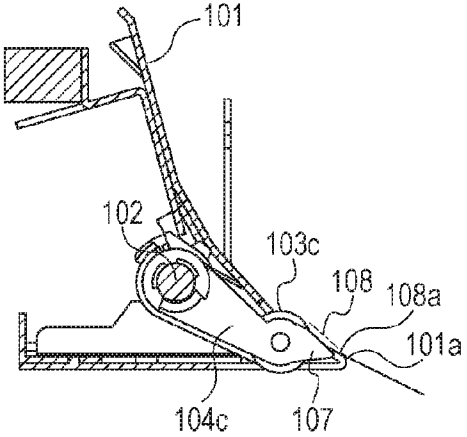
FIG. 1C is an explanatory drawing of a driven roller holder having a conveyance guide surface.
Figure 1D:
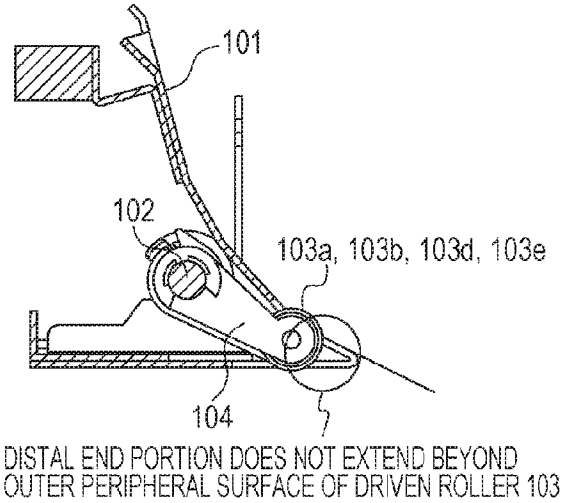
FIG. 1D is an explanatory drawing of a driven roller holder having no conveyance guide surface.
Figure 2:
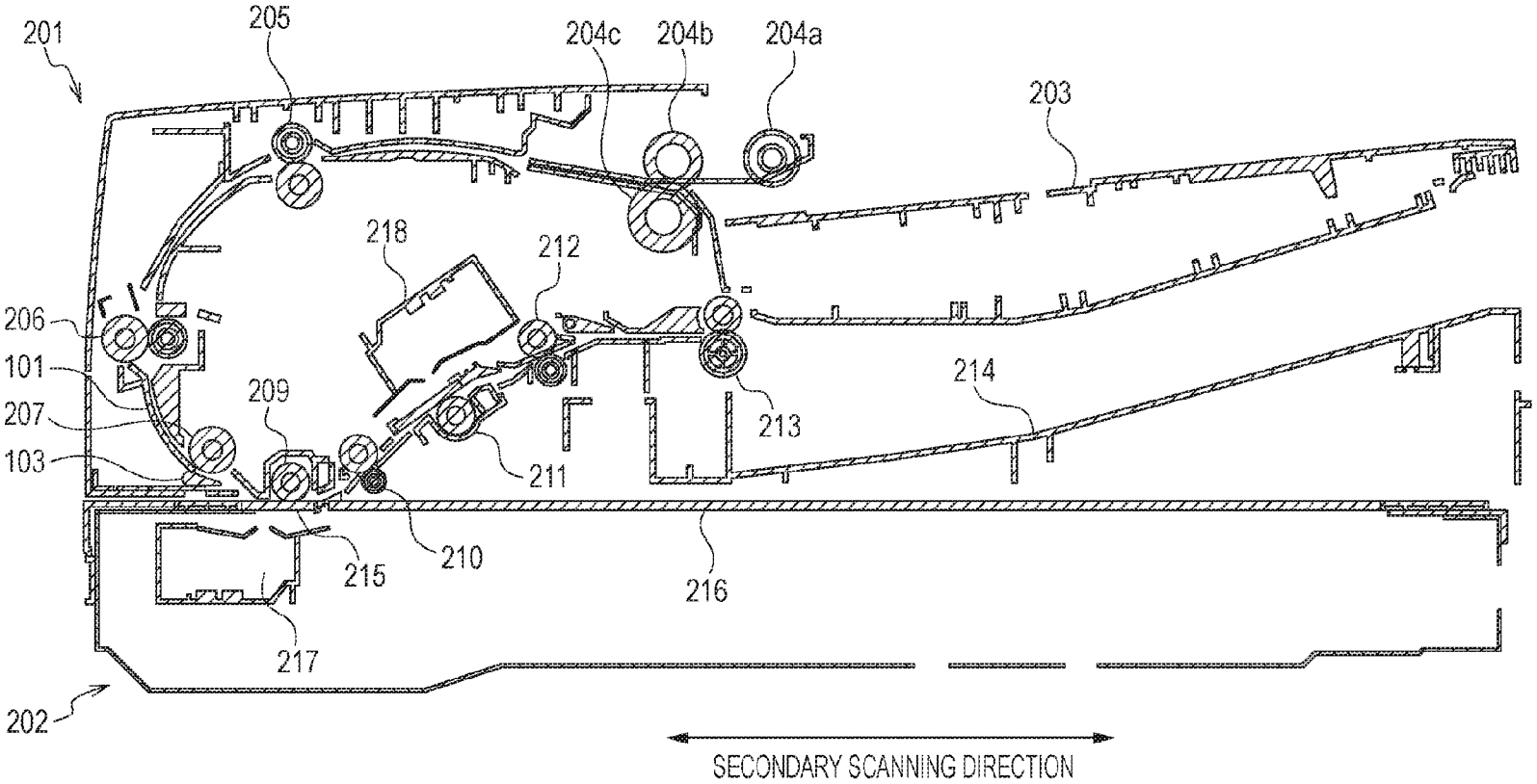
FIG. 2 is a drawing illustrating an outline of a sheet conveying unit.

FIG. 1A is a perspective view of a portion in the vicinity of a driven roller 103 in FIG. 2. FIG. 1B is a perspective view of the driven roller 103 in a state in which the conveyance guide 101 in FIG. 1A is not illustrated for the convenience of explanation. FIG. 1C is an explanatory drawing of a driven roller holder having a conveyance guide surface. FIG. 1D is an explanatory drawing of a driven roller holder having no conveyance guide surface.

As illustrated in FIG. 1B, roller units 111*a*/111*b*/111*c*/111*d*/111*e* include driven rollers 103*a*/103*b*/103*c*/103*d*/103*e*, driven roller holder 104*a*/104*b*/104*c*/104*d*/104*e* (roller holding portions), and driven roller pressing units 403*a*/403*b*/403*c*/403*d*/403*e* (biasing units). Reference symbols a, b, c, d, and e postfixed to reference numerals 111, 103, 104, and 403 are reference symbols for making the components of a plurality of units correspond in a one-to-one manner. In the case where the description does not need to discriminate the units, such symbols will be omitted.

Figure 3A:
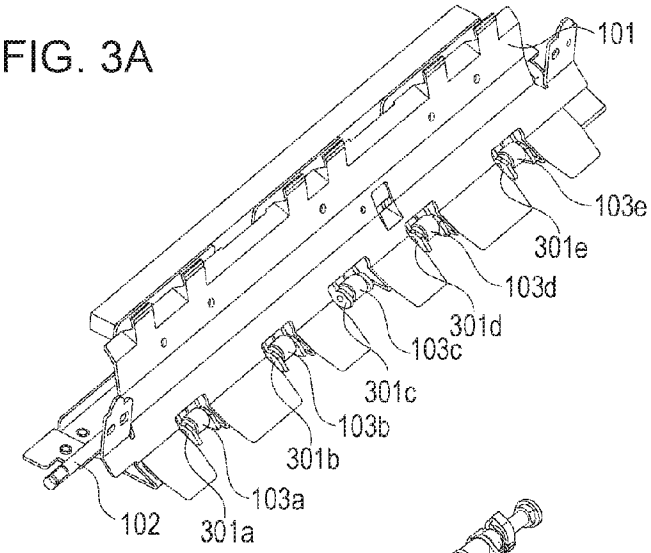
FIG. 3A is a perspective view of a portion in the vicinity of the driven roller according to a second embodiment.
Figure 3B:
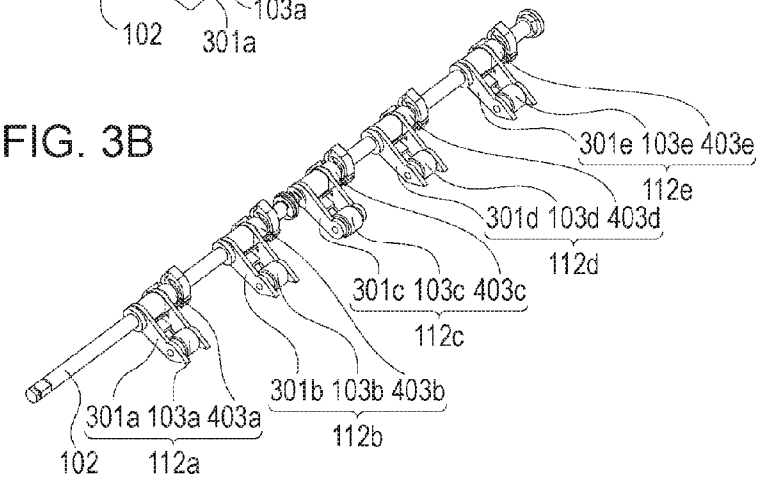
FIG. 3B is a perspective view of the driven roller in a state in which a conveyance guide in FIG. 3A is not illustrated for the convenience of explanation.

The driven roller 103 is provided under the driving roller 207 (opposed roller), which is provided so as to oppose the driven roller 103, and at least three of the driven rollers 103 are provided (FIGS. 3A and 3B). A plurality of the driven rollers 103*a* to 103*e* are arranged in a direction orthogonal to a sheet conveying direction and are provided so as to be brought into contact with the driving roller 207 by a driven roller pressing unit 403, which will be described later. In contrast, the driving roller 207 is formed of a single roller extending in the direction orthogonal to the sheet conveying direction and is driven by a driving source, which is not illustrated, to rotate in the document conveying direction. The driving roller 207 may be divided in one-to-one correspondence with the plurality of driven rollers 103. The driven roller 103 is rotatably supported by a driven roller holder 104. A driven roller holder 104 is rotatable about a rotary shaft 102. The driven roller pressing unit 403 is a torsion coil spring attached to the rotary shaft 102 and is configured to bias the driven roller holder 104 to bring the driven roller 103 into contact with the driving roller 207.

Referring now to FIG. 1C and FIG. 1D, a configuration of distal end portions of the driven roller holders 104*a* to 104*e* will be described. As illustrated in FIG. 1C, a distal end portion 107 of the driven roller holder 104*c* located at a center (center side of the conveying path) in a widthwise direction orthogonal to the sheet conveying direction extends downstream beyond an outer peripheral surface of the driven roller 103*c* in the conveying direction. The extended distal end portion 107 includes a conveyance guide surface 108 along which the document is conveyed. A downstream portion 108*a* of the conveyance guide surface 108 in the conveying direction is located below a guide portion 101*a*, which corresponds to a guide surface of the conveyance guide. Therefore, the document passed through the nip portion between the driven roller 103 and the driving roller 207 is gently delivered from the conveyance guide surface 108 to the conveyance guide 101, and occurrence of a shock when the document falls onto the conveyance guide 101 is alleviated.

In contrast, as illustrated in FIG. 1D, distal end portions of the driven roller holders 104*a*/104*b*/104*d*/104*e* arranged at positions (both end sides of the conveying path) farther from the center in the widthwise direction, which is orthogonal to the sheet conveying direction, do not extend downstream beyond outer peripheral surfaces of the driven rollers 103*a*/103*b*/103*d*/103*e*. Therefore, the driven roller holders 104*a*/104*b*/104*d*/104*e* do not have the conveyance guide surface at the distal end portions thereof.

With the configuration described above, the time when the document falls onto the conveyance guide 101 after the trailing edge of the conveyed document has passed through the nip portion between the driving roller 207 and the driven roller 103 may be differentiated depending on the part in the direction orthogonal to the conveying direction.

In other words, at the positions of the driven roller holders 104*a*/104*b*/104*d*/104*e*, the conveyance guide surface does not exist at the distal end portions of the driven roller holders 104*a*/104*b*/104*d*/104*e*. Therefore, after the trailing edge of the document has passed through the nip portion between the driving roller 207 and the driven roller 103, the document falls onto the conveyance guide 101 immediately. In contrast, part of the document at the position of the driven roller holder 104*c* falls onto the conveyance guide 101 later than parts of the document at the positions of the driven roller holders 104*a*/104*b*/104*d*/104*e* as the conveyance guide surface 108 is provided. The trailing-edge-leaving shock has a lower impact on the color deviation or the like in the case where parts of the document to fall onto the conveyance guide 101 prior to the remaining part of the document than a case where the entire part of the document falls onto the conveyance guide 101 at once. This is because the shock applied to the document when the document falls onto the conveyance guide 101 is alleviated.

In a case where guide surfaces having the same length were provided on all of the driven roller holders 104*a*/104*b*/104*c*/104*d*/104*e* (in the case where the guide surfaces having a length similar to that of the driven roller holder 104*c* in the first embodiment were provided on the driven roller holders 104*a*/104*b*/104*d*/104*e*), the problem of color deviation was not reduced much. The cause was supposed to be due to the conveying path between the driven roller holder 104 and the driving roller 207 being narrowed over the entire area in the direction orthogonal to the conveying direction, and thus some conveyance resistance was generated when the document was conveyed. Consequently, smooth conveyance of the document could not be achieved and thus the color deviation occurred.

Characteristics of the first embodiment will be summarized. The roller unit 111 includes a first roller unit 111*c* and second roller units 111*a*, 111*b*, 111*d*, and 111*e*. The first roller unit 111*c* includes the driven roller 103*c* (first roller), the driven roller holder 104*c* (first roller holding portion), and the driven roller pressing unit 403*c* (first biasing unit). The driven roller holder 104*c* is provided with a guide surface 108 (first extended portion) extending downstream beyond the driven roller 103*c* in the sheet conveying direction. The second roller units 111*a*, 111*b*, 111*d*, and 111*e* include the driven rollers 103*a*, 103*b*, 103*d*, and 103*e* (second rollers), the driven roller holders 104*a*, 104*b*, 104*d*, and 104*e* (second roller holding portions), and the driven roller pressing units 403*a*, 403*b*, 403*d*, and 403*e* (second biasing units). The driven roller holders 104*a*, 104*b*, 104*d*, and 104*e* do not have parts extending downstream beyond the driven rollers 103*a*, 103*b*, 103*d*, and 103*e* in the sheet conveying direction.

In the configuration described above, the problem of trailing-edge-leaving shock is reduced.

It seems that the same effects are achievable by providing the conveyance guide 101 and the like with a shape similar to the conveyance guide surface 108 of the driven roller holder 104 described in the first embodiment. However, the conveyance guide 101 is a separate component independent from the movement of the driven roller 103. If the conveyance guide surface is provided on a component independent from the driven roller such as the conveyance guide 101, a conveying path between the conveyance guide 101 and the driving roller 207 may become extremely narrow due to ununiformity caused by component tolerance or assembly. If the conveying path is narrowed in this manner, conveyance resistance of the document is increased, and thus smooth conveyance of the document cannot be achieved. Consequently, problems such as an image reading defect or JAM, which is a phenomenon in which a conveyance route is blocked by the document, may occur.

In contrast, as described in the first embodiment, by causing the driven roller holder 104 which holds the driven roller 103 to hold the conveyance guide surface 108, the influence of the ununiformity caused by the component tolerance and the assembly may be minimized. In addition, the driven roller holder 104 is rotatably supported by the rotary shaft 102 and thus is movable together with the driven roller 103. When the document passes through the nip portion between the driven roller 103 and the driving roller 207, the distance between the driven roller 103 and the driving roller 207 is increased by an amount corresponding to the thickness of the document. The driven roller holder 104 moves in association with the movement of the driven roller 103, and the conveying path between the conveying surface 108 of the driven roller holder 104 and the driving roller 207 is increased. Therefore, the configuration described in the first embodiment poses less risk of causing problems such as image reading defects and JAM due to an increased conveyance resistance than a configuration in which the conveyance guide 101 or the like has a shape similar to the conveyance guide surface 108.

In the case where three or more of the driven rollers 103 are provided, the driven rollers 103 having the guide surface 108 and the driven roller holders 104 having no guide surface can be arranged in lateral symmetry in the direction orthogonal to the sheet conveying direction. This lateral symmetrical arrangement of the driven roller holders 104 enables the trailing edge of the document to fall onto the conveyance guide 101 in a laterally symmetrical manner timewise. With this fall onto the conveyance guide 101 in a laterally symmetrical manner timewise, the influence of the trailing-edge-leaving shock may be reduced in comparison with a case where the fall onto the conveyance guide 101 does not occur in a laterally symmetrical manner timewise.

In the first embodiment, only the driven roller holder 104*c* at the center has the guide surface 108, and the remaining driven roller holders 104*a*, 104*b*, 104*d*, and 104*e* do not have the guide surface.

As described thus far, with the configuration described in the first embodiment, stable sheet conveyance with an alleviated shock occurring in the document caused by the fall of the trailing edge of the document onto the conveyance guide is enabled by a simple structure.

Second Embodiment

A second embodiment of the invention will be described with reference to FIGS. 3A to 3D. The second embodiment is different from the first embodiment in the arrangement of a driven roller holder 301 having a guide surface 108 and a driven roller holder 301 having no guide surface. Only points different from the first embodiment will be described and description of the same configurations as those in the first embodiment will be omitted.

Figure 3C:
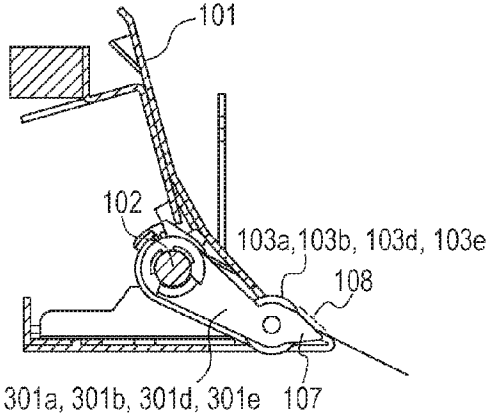
FIG. 3C is an explanatory drawing of a driven roller holder having a conveyance guide surface.
Figure 3D:
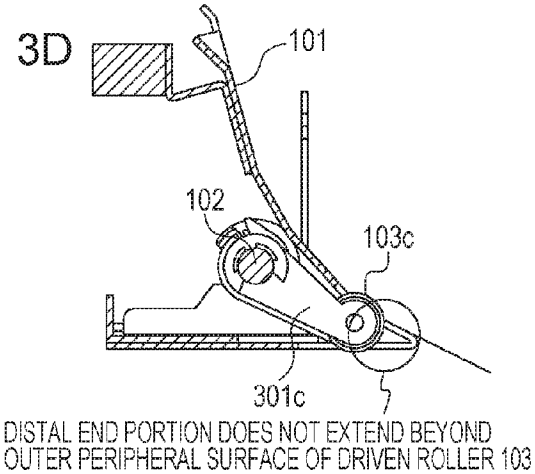
FIG. 3D is an explanatory drawing of a driven roller holder having no conveyance guide surface.

FIG. 3A is a perspective view of a portion in the vicinity of a driven roller 103 in FIG. 2. FIG. 3B is a perspective view of the driven roller 103 in a state in which a conveyance guide 101 in FIG. 3A is not illustrated for the convenience of explanation. FIG. 3C is an explanatory drawing of a driven roller holder having a conveyance guide surface. FIG. 3D is an explanatory drawing of a driven roller holder having no conveyance guide surface.

As illustrated in FIG. 3A and FIG. 3B, in the second embodiment, roller units 112*a*/112*b*/112*c*/112*d*/112*e* include the driven rollers 103*a*/103*b*/103*c*/103*d*/103*e*, driven roller holders 301*a*/301*b*/301*c*/301*d*/301*e* (roller holding portions), and driven roller pressing units 403*a*/403*b*/403*c*/403*d*/403*e* (biasing units).

As illustrated in FIG. 3C, distal end portions 107 of the driven roller holders 301*a*/301*b*/301*d*/301*e* arranged at positions (both end sides of the conveying path) farther from the center in the widthwise direction orthogonal to the sheet conveying direction extend downstream beyond the outer peripheral surfaces of the driven rollers 103*a*/103*b*/103*d*/103*e* in the conveying direction. The extended distal end portions 107 each include the conveyance guide surface 108 along which the document is conveyed.

In contrast, as illustrated in FIG. 3D, the distal end portion of the driven roller holder 301*c* located at a center (center side of the conveying path) in a widthwise direction orthogonal to the sheet conveying direction does not extend downstream beyond the outer peripheral surface of the driven roller 103*c*. Therefore, the driven roller holder 301*c* does not have the conveyance guide surface at the distal end portions thereof.

Characteristics of the second embodiment will be summarized. The roller unit 112 includes the first roller units 112*a*, 112*b*, 112*d*, and 112*e*, and the second roller unit 112*c*. The first roller units 112*a*, 112*b*, 112*d*, and 112*e*, include the driven rollers 103*a*, 103*b*, 103*d*, and 103*e* (first rollers), the driven roller holders 301*a*, 301*b*, 301*d*, and 301*e* (first roller holding portions), and the driven roller pressing units 403*a*, 403*b*, 403*d*, and 403*e* (first biasing units). The driven roller holders 301*a*, 301*b*, 301*d*, and 301*e* include the guide surface 108 (first extended portion) extending downstream beyond the driven rollers 103*a*, 103*b*, 103*d*, and 103*e* in the sheet conveying direction. The second roller unit 112*c* includes the driven roller 103*c* (second roller), the driven roller holder 301*c* (second roller holding portion), and the driven roller pressing unit 403*c* (second biasing unit). The driven roller holder 301*c* does not have a portion extending downstream beyond the driven roller 103*c* in the sheet conveying direction.

With the configuration described above, the time of the fall of the document onto the conveyance guide 101 after the trailing edge of the conveyed document has passed through the nip portion between the driving roller 207 and the driven roller 103 may be differentiated depending on the part in the direction orthogonal to the conveying direction. According to the second embodiment, the influence of the trailing-edge-leaving shock may be alleviated in the same manner as the first embodiment.

Third Embodiment

A third embodiment of the invention will be described with reference to FIGS. 4A to 4D. The third embodiment is different from the first embodiment in that the conveyance guide surfaces configured to guide the document are formed at distal end portions of all of the driven roller holders 401, respectively, and the amounts of extension of the guide surfaces are different depending on the driven roller holder 401. Only points different from the first embodiment will be described and description of other configurations similar to those of the first embodiment will be omitted.

Figure 4C:
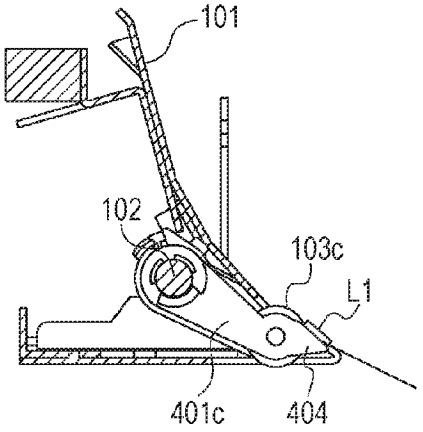
FIG. 4C is an explanatory drawing of a driven roller holder having a conveyance guide surface L1.
Figure 4D:
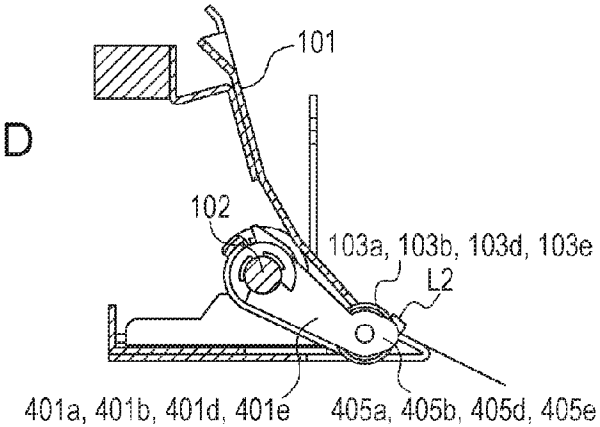
FIG. 4D is an explanatory drawing of a driven roller holder having a conveyance guide surface L2.
Figure 4A:
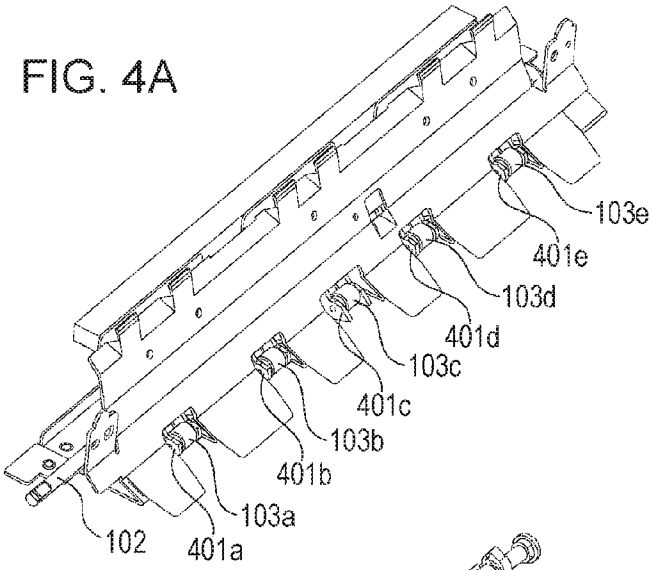
FIG. 4A is a perspective view of a portion in the vicinity of the driven roller according to a third embodiment.
Figure 4B:
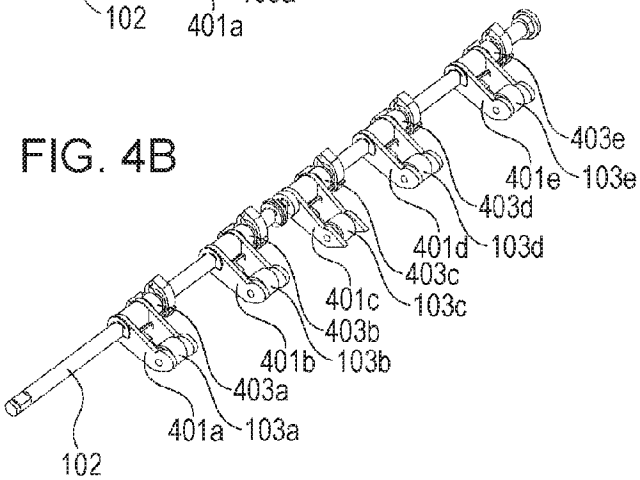
FIG. 4B is a perspective view of the driven roller in a state in which a conveyance guide in FIG. 4A is not illustrated for the convenience of explanation.

FIG. 4A is a perspective view of a portion in the vicinity of a driven roller 103 in FIG. 2. FIG. 4B is a perspective view of the driven roller 103 in a state in which a conveyance guide 101 in FIG. 4A is not illustrated for the convenience of explanation. FIG. 4C is an explanatory drawing of a driven roller holder having a conveyance guide surface L1. FIG. 4D is an explanatory drawing of a driven roller holder having a conveyance guide surface L2.

As illustrated in FIG. 4A and FIG. 4B, in the third embodiment, roller units 113*a*/113*b*/113*c*/113*d*/113*e* include the driven rollers 103*a*/103*b*/103*c*/103*d*/103*e*, driven roller holders 401*a*/401*b*/401*c*/401*d*/401*e* (roller holding portions), and driven roller pressing units 403*a*/403*b*/403*c*/403*d*/403*e* (biasing units).

As illustrated in FIG. 4C, a distal end portion 404 of the driven roller holder 401*c* located at a center (center side of the conveying path) in the widthwise direction orthogonal to the sheet conveying direction extends downstream beyond an outer peripheral surface of the driven roller 103*c* in the conveying direction. The extended distal end portions 404 each include the conveyance guide surface L1 along which the document is conveyed.

In contrast, as illustrated in FIG. 4D, distal end portions 405*a*/405*b*/405*d*/405*e* of the driven roller holders 401*a*/401*b*/401*d*/401*e* arranged at positions (both end sides of the conveying path) farther from the center in the widthwise direction orthogonal to the sheet conveying direction extend downstream beyond the outer peripheral surfaces of the driven rollers 103*a*/103*b*/103*d*/103*e* in the conveying direction. The extended distal end portions 405 each include the conveyance guide surface L2 along which the document is conveyed.

The conveyance guide surfaces L1 and L2 have different lengths so that a relationship of L1>L2 is satisfied. The lengths L1 and L2 are lengths from the outer periphery of the driven roller 103 to a downstream end of the driven roller holder 401.

Characteristics of the third embodiment will be summarized. The roller unit 113 includes the first roller unit 113*c* and the second roller units 113*a*, 113*b*, 113*d*, and 113*e*. The first roller unit 113*c* includes the driven roller 103*c* (first roller), the driven roller holder 401*c* (first roller holding portion), and the driven roller pressing unit 403*c* (first biasing unit). The driven roller holder 401*c* is provided with the guide surface L1 (first extended portion) extending downstream beyond the driven roller 103*c* in the sheet conveying direction. The second roller units 113*a*, 113*b*, 113*d*, and 113*e* include the driven rollers 103*a*, 103*b*, 103*d*, and 103*e* (second rollers), the driven roller holders 405*a*, 405*b*, 405*d*, and 405*e* (second roller holding portions), and the driven roller pressing units 403*a*, 403*b*, 403*d*, and 403*e* (second biasing units). The driven roller holders 405*a*, 405*b*, 405*c*, and 405*e* each include the guide surface L2 (second extended portions) extending downstream beyond the driven rollers 103*a*, 103*b*, 103*d*, and 103*e* in the sheet conveying direction. The amount of extension of the guide surface L1 is larger than that of the guide surface L2 (L1>L2).

With the configuration described above, when the trailing edge of the document has passed through the nip between the driving roller 207 and the driven roller 103, the document is guided by a driven roller holders 401 provided with the conveyance guide surfaces L1 and L2 having different lengths. The trailing edge of the document falls onto the conveyance guide 101 at points where the driven roller holders 401*a*/401*b*/401*c*/401*d* each having a shorter conveyance guide surface (L2) are arranged, prior to a point where the driven roller holder 402 having a longer conveyance guide surface (L1) is arranged. In this manner, the time of the fall of the trailing edge of the document onto the conveyance guide 101 may be differentiated depending on the part by providing the lengths L1/L2 of the conveyance guide surfaces with a relationship of L1>L2, whereby the trailing-edge-leaving shock may be alleviated.

Fourth Embodiment

A fourth embodiment of the invention will be described with reference to FIGS. 5A to 5D. The fourth embodiment is different from the first embodiment in that the conveyance guide surfaces configured to guide the document are formed at distal end portions of all of the driven roller holders 401, and the amounts of extension of the guide surfaces are different depending on the driven roller holder 401. Only points different from the first embodiment will be described and description of the same configurations as those in the first embodiment will be omitted.

Figure 5A:
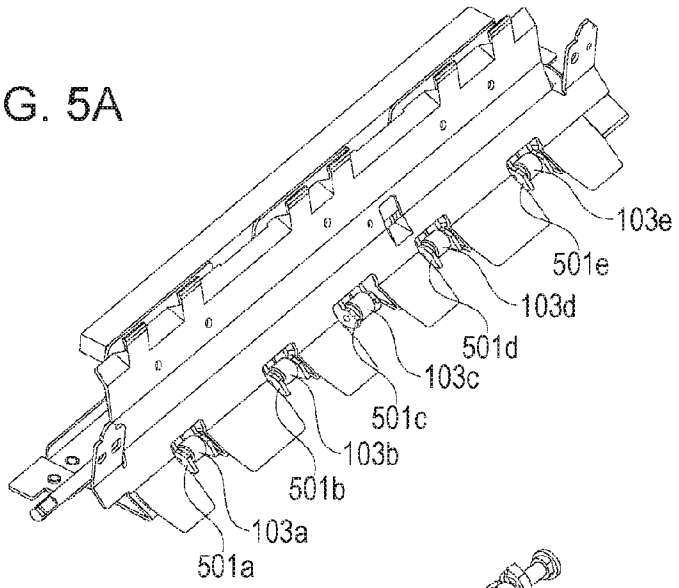
FIG. 5A is a perspective view of a portion in the vicinity of the driven roller according to a fourth embodiment.
Figure 5B:
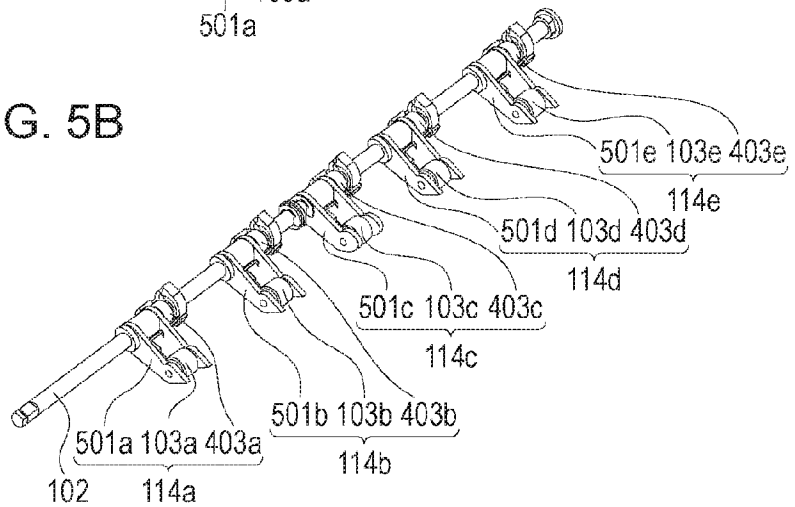
FIG. 5B is a perspective view of the driven roller in a state in which a conveyance guide in FIG. 5A is not illustrated for the convenience of explanation.
Figure 5D:
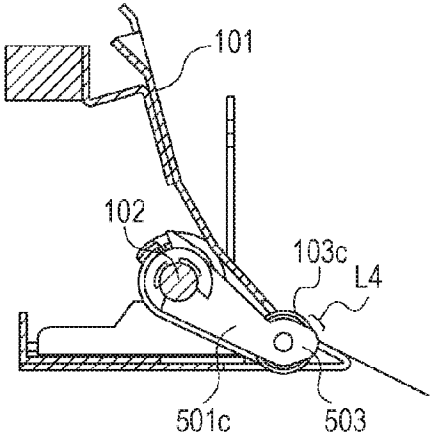
FIG. 5D is an explanatory drawing of a driven roller holder having a conveyance guide surface L4.
Figure 5C:
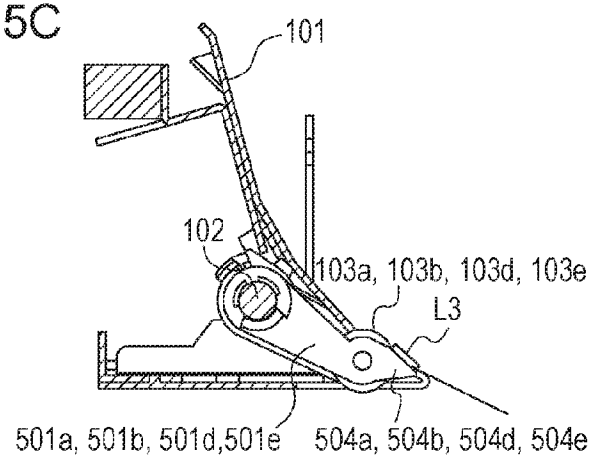
FIG. 5C is an explanatory drawing of a driven roller holder having a conveyance guide surface L3.

FIG. 5A is a perspective view of a portion in the vicinity of a driven roller 103 in FIG. 2. FIG. 5B is a perspective view of the driven roller 103 in a state in which a conveyance guide 101 in FIG. 5A is not illustrated for the convenience of explanation. FIG. 5C is an explanatory drawing of a driven roller holder having a conveyance guide surface L3. FIG. 5D is an explanatory drawing of a driven roller holder having a conveyance guide surface L4.

As illustrated in FIG. 5A and FIG. 5B, in the fourth embodiment, roller units 114*a*/114*b*/114*c*/114*d*/114*e* include the driven rollers 103*a*/103*b*/103*c*/103*d*/103*e*, driven roller holders 501*a*/501*b*/501*c*/501*d*/501*e* (roller holding portions), and driven roller pressing units 403*a*/403*b*/403*c*/403*d*/403*e* (biasing units).

As illustrated in FIG. 5C, distal end portions 504*a*/504*b*/504*d*/504*e* of the driven roller holders 501*a*/501*b*/501*d*/501*e* arranged at positions (both end sides of the conveying path) farther from the center in the widthwise direction orthogonal to the sheet conveying direction extend downstream beyond the outer peripheral surfaces of the driven rollers 103*a*/103*b*/103*d*/103*e* in the conveying direction. The extended distal end portions 504 each include the conveyance guide surface L3 along which the document is conveyed.

In contrast, as illustrated in FIG. 5D, the distal end portion 503 of the driven roller holder 501*c* located at a center (center side of the conveying path) in the widthwise direction orthogonal to the sheet conveying direction extends downstream beyond the outer peripheral surface of the driven roller 103*c* in the conveying direction. The extended distal end portions 503 each include the conveyance guide surface L4 along which the document is conveyed.

The conveyance guide surfaces L3 and L4 have different lengths so that a relationship of L3>L4 is satisfied. The lengths L3 and L4 are lengths from the outer periphery of the driven roller 103 to a downstream end of the driven roller holder 501.

Characteristics of the fourth embodiment will be summarized. The roller unit 114 includes the first roller unit 114*c* and the second roller units 114*a*, 114*b*, 114*d*, and 114*e*. The first roller unit 114*c* includes a driven roller 103*c* (first roller), a driven roller holder 501*c* (first roller holding portion), and a driven roller pressing unit 403*c* (first biasing unit). The driven roller holder 501*c* is provided with the guide surface L4 (first extended portion) extending downstream beyond the driven roller 103*c* in the sheet conveying direction. The second roller units 114*a*, 114*b*, 114*d*, and 114*e* include the driven rollers 103*a*, 103*b*, 103*d*, and 103*e* (second rollers), the driven roller holders 501*a*, 501*b*, 501*d*, and 501*e* (second roller holding portions), and the driven roller pressing units 403*a*, 403*b*, 403*d*, and 403*e* (second biasing units). The driven roller holders 501*a*, 501*b*, 501*d*, and 501*e* each include the guide surface L3 (second extended portions) extending downstream beyond the driven rollers 103*a*, 103*b*, 103*d*, and 103*e* in the sheet conveying direction. The amount of extension of the guide surface L3 is larger than that of the guide surface L4 (L3>L4).

With the configuration described above, when the trailing edge of the document has passed through the nip between the driving roller 207 and the driven roller 103, the document is guided by the driven roller holders 501 provided with the conveyance guide surface L3 or L4 having different lengths. The trailing edge of the document falls onto the conveyance guide 101 at a point where the driven roller holder 501*c* having the shorter conveyance guide surface (L4) is arranged prior to points where the driven roller holders 501*a*, 501*b*, 501*d*, and 501*e* each having the longer conveyance guide surface (L3) are arranged. In this manner, the time of the fall of the trailing edge of the document onto the conveyance guide 101 may be differentiated depending on the by providing the lengths L3/L4 of the conveyance guide surfaces with a relationship of L3>L4, whereby the trailing-edge-leaving shock may be alleviated.

Others

In the third and fourth embodiments, the configurations in which all of the driven roller holders each include the guide surface that guides the document have been described. However, the driven roller holders having no guide surface and the driven roller holders having different lengths of guide surfaces may be combined. For example, a configuration in which driven roller holders on the outermost side in the direction orthogonal to the sheet conveying direction have no guide surface, next driven roller holders on the inner side each have a short guide surface, and driven roller holders located further inside each have a long guide surface is also applicable.

According to the invention, an image reading device and an image forming apparatus which achieve alleviation of the trailing-edge-leaving shock by a simple configuration is provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-264784, filed Dec. 26, 2014, which is hereby incorporated by reference herein in its entirety.

What is claimed is:

1. An image reading device comprising:

an image reader; and a conveying portion configured to convey a sheet to an image reading position where the sheet is read by the image reader, the conveying portion including:

a first roller unit, the first roller unit including:

a first roller provided under an opposed roller;

a first roller holding portion configured to hold the first roller and rotatably provided on a rotary shaft; and a first biasing portion configured to bias the first roller holding portion to bring the first roller into contact with the opposed roller; and a second roller unit, the second roller unit including:

a second roller provided under the opposed roller;

a second roller holding portion configured to hold the second roller and rotatably provided on a rotary shaft; and a second biasing portion configured to bias the second roller holding portion to bring the second roller into contact with the opposed roller, wherein the first roller unit and the second roller units are arranged at a position immediately upstream of the image reading position in a sheet conveying direction and are arranged at different positions in a direction orthogonal to the sheet conveying direction, the first roller holding portion includes a first extended portion extending downstream beyond the first roller in the sheet conveying direction, and the second roller holding portion does not include an extended portion extending downstream beyond the second roller in the sheet conveying direction.

2. The image reading device according to claim 1, wherein the first roller unit is arranged at a center in the direction orthogonal to the sheet conveying direction, and the second roller unit is arranged at an end portion in the direction orthogonal to the sheet conveying direction.

3. The image reading device according to claim 1, wherein the first roller unit is arranged at an end portion in the direction orthogonal to the sheet conveying direction, and the second roller unit is arranged at a center in the direction orthogonal to the sheet conveying direction.

4. The image reading device according to claim 1, comprising a conveyance guide which is allowed to guide the sheet at a position different from the first extended portion in the direction orthogonal to the sheet conveying direction, wherein a downstream portion of the first extended portion in the sheet conveying direction is located below a guide surface of the conveyance guide.

5. The image reading device according to claim 1, wherein the opposed roller is a driving roller configured to rotate in response to being driven by a driving source.

6. An image forming apparatus comprising:

an image forming unit configured to form an image on a sheet; and an image reading device, the image reading device including:

an image reader;

a conveying portion configured to convey a sheet to an image reading position where the sheet is read by the image reader, the conveying portion including:

a first roller unit, the first roller unit including:

a first roller provided under an opposed roller;

a first roller holding portion configured to hold the first roller and rotatably provided on a rotary shaft; and a first biasing portion configured to bias the first roller holding portion to bring the first roller into contact with the opposed roller, and a second roller unit, the second roller unit including:

a second roller provided under the opposed roller;

a second roller holding portion configured to hold the second roller and rotatably provided on a rotary shaft; and a second biasing portion configured to bias the second roller holding portion to bring the second roller into contact with the opposed roller, wherein the first roller unit and the second roller units are arranged at a position immediately upstream of the image reading position in a sheet conveying direction and are arranged at different positions in a direction orthogonal to the sheet conveying direction, the first roller holding portion includes a first extended portion extending downstream beyond the first roller in the sheet conveying direction, and the second roller holding portion does not include an extended portion extending downstream beyond the second roller in the sheet conveying direction.

7. An image reading device comprising:

an image reader; and a conveying portion configured to convey a sheet to an image reading position where the sheet is read by the image reader, the conveying portion including:

a first roller unit, the first roller unit including:

a first roller provided under an opposed roller;

a first roller holding portion configured to hold the first roller and rotatably provided with respect to a rotary shaft; and a first biasing portion configured to bias the first roller holding portion to bring the first roller into contact with the opposed roller; and a second roller unit;

the second roller unit including:

a second roller provided under the opposed roller;

a second roller holding portion configured to hold the second roller and rotatably provided with respect to a rotary shaft; and a second biasing portion configured to bias the second roller holding portion to bring the second roller into contact with the opposed roller, wherein the first roller unit and the second roller units are arranged at a position immediately upstream of the image reading position in a sheet conveying direction and are arranged at different positions in a direction orthogonal to the sheet conveying direction, the first roller holding portion includes a first extended portion extending downstream beyond the first driven roller in the sheet conveying direction, the second roller holding portion includes a second extended portion extending downstream beyond the second driven roller in the sheet conveying direction, and the first extended portion extends by an amount more than the second extended portion.

8. The image reading device according to claim 7, wherein the first roller unit is arranged at a center in the direction orthogonal to the sheet conveying direction, and the second roller unit is arranged at an end portion in the direction orthogonal to the sheet conveying direction.

9. The image reading device according to claim 7, wherein the first roller unit is arranged at an end portion in the direction orthogonal to the sheet conveying direction, and the second roller unit is arranged at a center in the direction orthogonal to the sheet conveying direction.

10. The image reading device according to claim 7, comprising a conveyance guide which is allowed to guide the sheet at a position different from the first extended portion in the direction orthogonal to the sheet conveying direction, wherein a downstream portion of the first extended portion in the sheet conveying direction is located below a guide surface of the conveyance guide.

11. The image reading device according to claim 7, wherein the opposed roller is a driving roller configured to rotate in response to being driven by a driving source.

12. An image forming apparatus comprising:

an image forming unit configured to form an image on a sheet; and an image reading device, the image reading device including:

an image reader;

a conveying portion configured to convey a sheet to an image reading position where the sheet is read by the image reader, the conveying portion including;

a first roller unit, the first roller unit including:

a first roller provided under an opposed roller;

a first roller holding portion configured to hold the first roller and rotatably provided with respect to a rotary shaft; and a first biasing portion configured to bias the first roller holding portion to bring the first roller into contact with the opposed roller; and a second roller unit, the second roller unit including:

a second roller provided under the opposed roller;

a second roller holding portion configured to hold the second roller and rotatably provided with respect to a rotary shaft; and a second biasing portion configured to bias the second roller holding portion to bring the second roller into contact with the opposed roller; wherein the first roller unit and the second roller units are arranged at a position immediately upstream of the image reading position in a sheet conveying direction and are arranged at different positions in a direction orthogonal to the sheet conveying direction, the first roller holding portion includes a first extended portion extending downstream beyond the first driven roller in the sheet conveying direction, and the second roller holding portion includes a second extended portion extending downstream beyond the second driven roller in the sheet conveying direction, and the first extended portion extends by an amount more than the second extended portion.

13. An image reading device comprising:

an image reader; and a conveying portion configured to convey a sheet to an image reading position where the sheet is read by the image reader, the conveying portion including;

an opposite roller;

a plurality of rollers, including a first roller and a second roller, provided under the opposite roller so as to be allowed to come into contact with the opposite roller and arranged in a direction orthogonal to a sheet conveying direction;

a first roller holding portions configured to support the first roller;

a second roller holding portion configured to support the second roller;

first extended portion provided at the first roller holding portions, and extending downstream beyond the first roller in the sheet conveying direction; and a second extended portion provided at the second roller holding portion, and extending downstream beyond the second roller in the sheet conveying direction, wherein a length of the first extended portion and a length of the second extended portion are different from each other.

14. The image reading device according to claim 13, wherein the first roller holding portion is arranged on a center side of the sheet conveying path in the direction orthogonal to a sheet conveying direction, and the second roller holding portion is arranged on end side in the direction orthogonal to a sheet conveying direction.

15. The image reading device according to claim 14, wherein the length of the first extended portion roller is longer than the length of the second extended portion.

16. The image reading device according to claim 14, wherein the length of the second extended portion is longer than the length of the first extended portion.

17. The image reading device according to claim 13, wherein the opposite roller is a drive roller, and the first roller and the second roller are driven rollers.

18. An image forming apparatus comprising:

an image forming unit configured to form an image on a sheet; and an image reading device, the image reading device including:

an image reader;

a conveying portion configured to convey a sheet to an image reading position where the sheet is read by the image reader, the conveying portion including:

an opposite roller;

a plurality of rollers, including a first roller and a second roller, provided under the opposite roller so as to be allowed to come into contact with the opposite roller and arranged in a direction orthogonal to a sheet conveying direction;

a first roller holding portion configured to support the first roller;

a second roller holding portion configured to support the second roller; and a first extended portion provided at the first roller holding portion, and extending downstream beyond the first roller in the sheet conveying direction; and a second extended portion provided at the second roller holding portion, and extending downstream beyond the second roller in the sheet conveying direction, wherein a length of the first extended portion and a length of the second extended portion are different from each other.

19. An image reading device comprising:

an image reader; and a conveying portion configured to convey a sheet to an image reading position where the sheet is read by the image reader, the conveying portion including:

an opposite roller;

a plurality of rollers, including a first roller and a second roller, provided so as to be allowed to come into contact with the opposite roller and arranged in a direction orthogonal to a sheet conveying direction; and a first roller holding portion configured to support the first roller, a second roller holding portion configured to support the second roller, wherein the first roller holding portion having an extended portion extending downstream beyond the first roller in the sheet conveying direction and the second roller holding portion having no extended portion extending downstream beyond the second roller in the sheet conveying direction.

20. The image reading device according to claim 19, wherein the first roller holding portion is arranged on a center side of the sheet conveying path in the direction orthogonal to a sheet conveying direction, and the second roller holding portions is arranged on end side in the direction orthogonal to a sheet conveying direction.

21. The image reading device according to claim 19, wherein the first roller holding portions is arranged on an end side of a sheet conveying path in the direction orthogonal to a sheet conveying direction, and the second roller holding portion is arranged on the center side of the conveying path.

22. An image forming apparatus comprising:

an image forming unit configured to form an image on a sheet; and an image reading device, the image reading device including:

an image reader;

a conveying portion configured to convey a sheet to an image reading position where the sheet is read by the image reader, the conveying portion including;

the conveying portion including;

an opposite roller;

a plurality of rollers, including a first roller and a second roller, provided so as to be allowed to come into contact with the opposite roller and arranged in a direction orthogonal to a sheet conveying direction; and a first roller holding portion configured to support the first roller, a second roller holding portion configured to support the second roller, wherein the first roller holding portions includes having an extended portion extending downstream beyond the first roller in the sheet conveying direction and the second roller holding portion having no extended portion extending downstream beyond the second roller in the sheet conveying direction.

23. The image reading device according to claim 19, wherein the opposite roller is a drive roller, and the first roller and the second roller are driven rollers.

24. The image reading device according to claim 1, wherein the opposed roller includes a first opposed roller which contacts with the first roller and a second opposed roller which contacts with the second roller, wherein the first roller and the second roller are arranged at the different positions in the direction orthogonal to the sheet convey direction.

25. The image reading device according to claim 7, wherein the opposed roller includes a first opposed roller which contacts with the first roller and a second opposed roller which contacts with the second roller, wherein the first roller and the second roller are arranged at the different positions in the direction orthogonal to the sheet convey direction.

26. The image reading device according to claim 13, wherein the opposed roller includes a first opposed roller which contacts with the first roller and a second opposed roller which contacts with the second roller, wherein the first roller and the second roller are arranged at the different positions in the direction orthogonal to the sheet convey direction.

27. The image reading device according to claim 19, wherein the opposed roller includes a first opposed roller which contacts with the first roller and a second opposed roller which contacts with the second roller, wherein the first roller and the second roller are arranged at the different positions in the direction orthogonal to the sheet convey direction.

* * * * *